United States Patent [19]

Finnegan et al.

[11] Patent Number: 5,042,600

[45] Date of Patent: Aug. 27, 1991

[54] DRILL PIPE WITH HELICAL RIDGE FOR DRILLING HIGHLY ANGULATED WELLS

[75] Inventors: John E. Finnegan, London, England; Jerry G. Williams, Ponca City, Okla.

[73] Assignee: Conoco Inc., Ponca City, Okla.

[21] Appl. No.: 498,864

[22] Filed: Mar. 23, 1990

[51] Int. Cl.[5] ..... E21B 17/22

[52] U.S. Cl. ..... 175/323; 175/325

[58] Field of Search ..... 175/323, 325; 324/356, 324/369

[56] References Cited

U.S. PATENT DOCUMENTS

| | | | |
|---|---|---|---|
| 2,336,029 | 12/1943 | Ogarrio . | |
| 2,781,185 | 2/1957 | Robbins . | |
| 2,815,192 | 12/1957 | Parrish . | |
| 3,085,639 | 4/1963 | Fitch | 175/323 |
| 3,085,639 | 4/1963 | Fitch . | |
| 3,656,565 | 4/1972 | Fox . | |
| 3,833,071 | 9/1974 | Koosman . | |
| 4,049,066 | 9/1977 | Richey . | |
| 4,277,869 | 7/1981 | Hartwell . | |
| 4,484,642 | 11/1984 | Evans . | |
| 4,543,019 | 9/1985 | Shikata | 175/323 |
| 4,610,316 | 9/1986 | Boaz | 175/323 |
| 4,771,830 | 9/1988 | Peate . | |
| 4,883,135 | 11/1989 | Moser et al. | 175/323 |
| 4,912,415 | 3/1990 | Sorensen | 175/50 |

FOREIGN PATENT DOCUMENTS

| | | | |
|---|---|---|---|
| 214513 | 3/1958 | Australia | 175/323 |
| 30716 | 5/1960 | Finland | 175/323 |
| 1065283 | 4/1967 | United Kingdom | 175/323 |

*Primary Examiner*—Ramon S. Britts
*Assistant Examiner*—Roger J. Schoeppel
*Attorney, Agent, or Firm*—A. Joe Reinert

[57] ABSTRACT

The drilling of highly angulated wellbores (with a rotary rig having a drill string terminated with a bit wherein drilling fluid is employed) is improved by employing in the highly angulated drill string a length of drill pipe which has a helical ridge disposed thereabout such that the flight of the helical ridge is wound so as to rise from the bit with the rotation of the drill string and the height of the helical ridge above the length of the surface of the drill pipe is 1 to 15 percent of the diameter of the drill pipe.

17 Claims, 2 Drawing Sheets

DRILL PIPE WITH HELICAL RIDGE FOR DRILLING HIGHLY ANGULATED WELLS

BACKGROUND OF THE INVENTION

1. Field of the Invention

The present invention relates to an improvement in the drilling of highly angulated wellbores with a rotary rig which has a drill string terminated with a bit and which employs circulating drilling mud.

2. Description of the Prior Art

As those skilled in the art are aware, the art of drilling wellbores is highly developed, and a number of devices and developments which are useful in drilling vertical wellbores with a rotary rig having recirculating mud are available. Also, horizontal augers are employed for drilling relatively short horizontal bores.

With depleting oil reserves, a need exists for improved efficiencies in drilling wellbores and recovering oil from the remaining reserves. One means of increasing efficiency is by use of highly angulated wellbores, which in many cases are horizontal or nearly horizontal. Such wellbores are often drilled with conventional rotary rigs having a drill string terminated with a bit wherein drilling mud is pumped down the drill string to exit at or near the drill bit so as to remove cuttings from the wellbore, cool the bit, and provide pressure control. When horizontal or highly angulated wells are drilled, particularly over a substantial horizontal distance, a problem of removing the cuttings from the horizontal or highly deviated wellbore arises because the cuttings settle out of the mud onto the bottom of the angulated hole.

Another problem that arises is that wear on the drill string is often substantially increased.

Particularly when long outreach highly angulated or horizontal wells are drilled, the drill string also becomes subject to substantially increased torsional stresses and stresses leading to buckling.

Some devices and developments known to be useful for drilling vertical wellbores with a rotary rig or with horizontal augers for drilling relatively short horizontal bores have a superficial relationship to the invention of this application. The prior art statement which is filed concurrently with this patent application notes references to such devices and developments and comments on their relationship to the invention at hand. In general, the prior art developments relate to different systems than drilling highly angulated wells with a rotary rig having a drill string terminated with a bit which employs circulating drilling mud, and such developments function in a different manner such as to obtain different results than is the case with the invention disclosed and claimed herein.

The invention of the application addresses the need for improved equipment and methods for drilling the highly angulated wellbores which are useful to more efficiently recover remaining oil reserves. It fulfills a need of the industry to solve problems associated therewith such as are noted above.

SUMMARY OF THE INVENTION

Accordingly, it is the general purpose and object of the present invention to provide an improvement in method and apparatus for drilling highly angulated wellbores wherein a rotary rig having a drilling string terminated with a bit wherein circulating drilling fluid is employed.

In accordance with our invention, while certain specific arrangements of parts and steps have been illustrated for the purpose of the present disclosure, numerous changes in the construction and arrangement of the steps and parts may be made by those skilled in the art, which changes are encompassed within the scope and spirit of the present invention as defined by the appended claims.

DETAILED DESCRIPTION OF THE INVENTION

Figure 1:
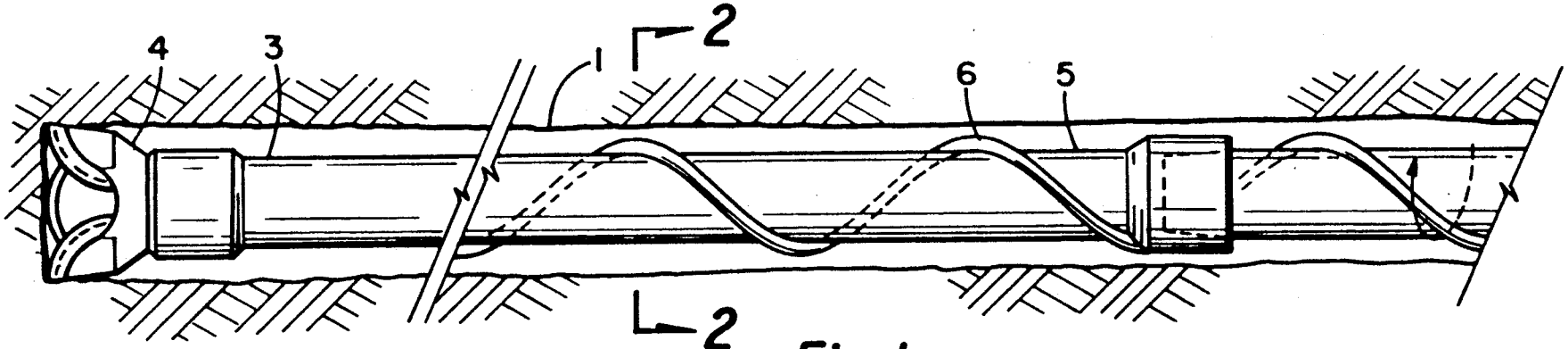
FIG. 1 shows a length of drill pipe situated in a drill string in a highly angulated wellbore having a helical ridge disposed thereabout wherein the drill string is terminated with a bit.

FIG. 1 shows a horizontal bore hole having a drill string terminated with a bit situated therein. The horizontal bore hole is a highly angulated example of the invention wherein there is 90° angulation from vertical. A drill string 3 terminated with a bit 4 which ejects drilling fluid is situated in the horizontal wellbore. It is powered to turn clockwise at the surface of the earth by a conventional rotary rig which injects drilling fluid down the hollow drill string, with ejection at the drill bit and flow back through the annulus around the drill string to the surface. The flow of the drilling fluid through the annulus serves to lubricate the drill string and to flush drill cuttings back to the surface.

Use of rotary rigs with drill strings terminated with bits employ circulating drill fluid or mud is a conventional way of drilling wells for production of hydrocarbons. Presently, the industry is finding very substantial advantages in many situations to use highly angulated wellbores or horizontal wellbores to increase production and cut costs. This leads to a problem with conventional drill strings in that the cuttings tend to settle, particularly when long outreach horizontal drilling is practiced. The settling cuttings lead to binding and stuck drill strings and increased wear on the drill string.

This problem of settling cuttings in the angulated wellbores is solved or highly mitigated in accordance with our invention. The helical ridge on the drill pipe keeps the cuttings in suspension, reduces friction and aids in moving the particles and mud to the surface.

Referring back to FIG. 1, a length of drill pipe 5 having a helical ridge 6 disposed thereabout wherein the flight of the helical ridge is wound in the same direction as the rotation of the drill string is employed. Thus, rotation of the drill string moves the drill cuttings in a direction from the bit to the surface in the highly angulated wellbore, thus avoiding build-up of cuttings, stuck drill strings, much friction, and excessive wear. The height of the helical ridge above the surface of the drill pipe is 1 to 15 percent of the outer diameter of the drill string. More preferably, the height of the helical ridge is 1 to 10 percent of the outer diameter of the drill pipe.

Figure 2:
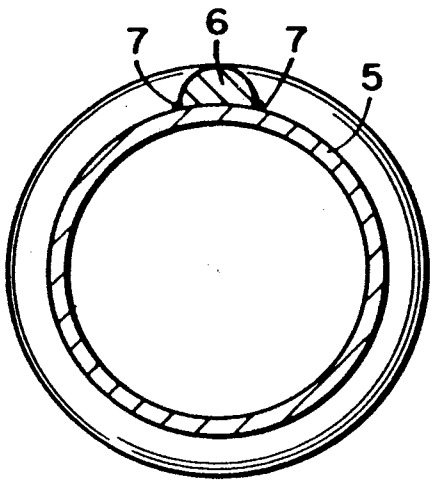
FIG. 2 shows a cross section of FIG. 1 taken from left to right wherein the helical ridge has a hemispherical cross section.

The helical ridge can have any of a variety of cross sectional shapes. For example, FIG. 2 taken along line 2—2 looking from the drill bit to the right shows a semi-hemispherical helical ridge 6 affixed to drill string 5 with welds 7.

Figure 3:
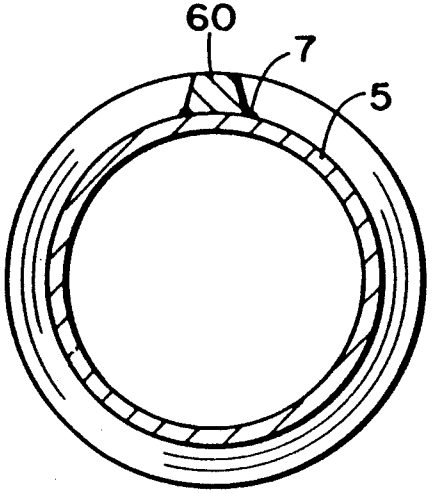
FIG. 3 shows a cross section of FIG. 1 along line 2 taken from left to right wherein the helical ridge has a trapezoidal cross section.

Similar manner, FIG. 3 shows a helical ridge having trapezoidal cross section 60 affixed to drill string 5 by welds 7.

Figure 4:
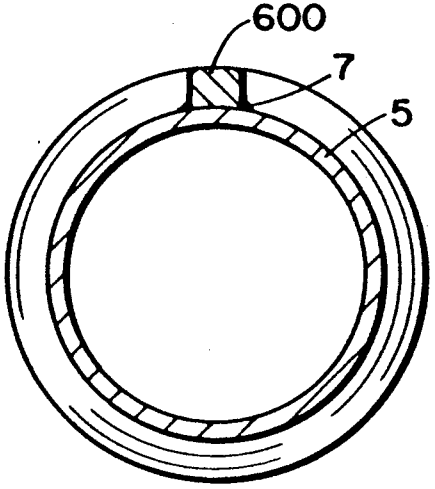
FIG. 4 shows a cross section taken along line 2 of FIG. 1 from left to right wherein the helical ridge has a rectangular cross section.

In similar manner, FIG. 4 shows a helical ridge 600 having rectangular cross section affixed to drill string 5 by welds 7.

For substantially highly angulated or horizontal outreach, a plurality of lengths of drill pipe having a helical ridge disposed thereabout are employed. Preferably, the ratio of drill pipes having a helical ridge to ordinary drill pipes in the drill string in the highly angulated wellbore ranges from at least 2 to substantially all of the drill pipes.

The term angulated wellbore, as used herein means a wellbore which is not more than 45° from horizontal, and includes wellbores which are 90° from vertical, or completely horizontal.

The helical ridge has a length axial to the long axis of the drill pipe of 50 to 500 percent of the outer diameter of the drill pipe in a 360° rotation about the drill pipe.

More preferably, according to our invention, the height of the helical ridge is 2 to 8 percent of the outer diameter of the drill pipe, a 360° rotation of the helical ridge has a length axial to the long axis of the drill pipe of 100 to 200 percent of the outer diameter of the drill pipe, and the width of the root of the helical ridge is 0.25 to 25 percent of the outer circumference of the drill pipe.

Figure 5:
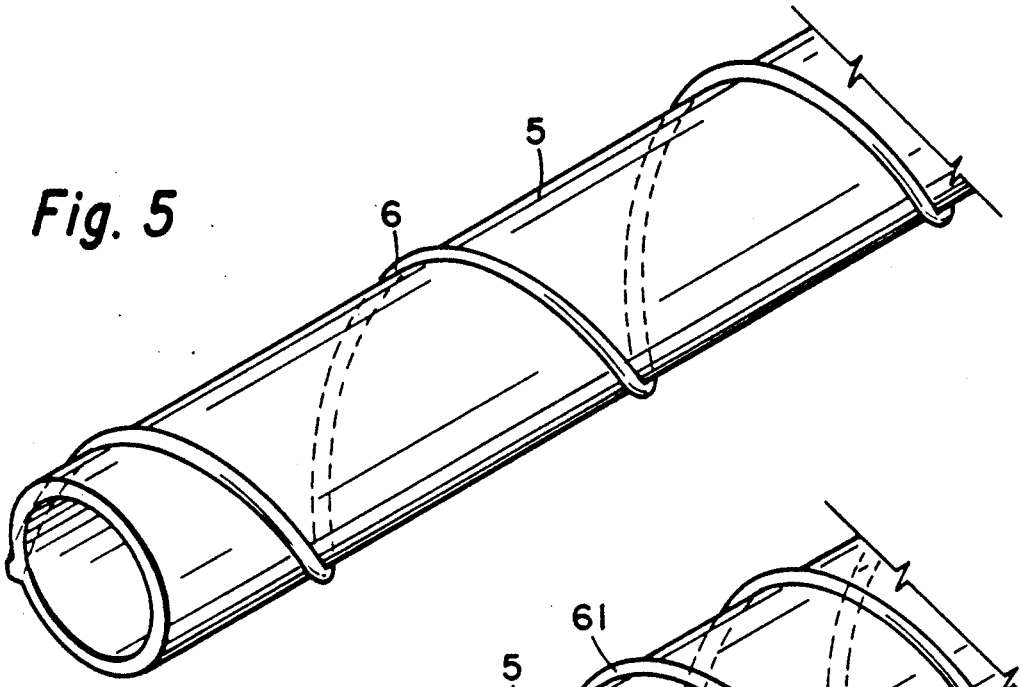
FIG. 5 shows a length of drill pipe having a single helical ridge disposed thereabout.

FIG. 5 shows a length of drill pipe which has a single helical ridge disposed thereabout.

Figure 6:
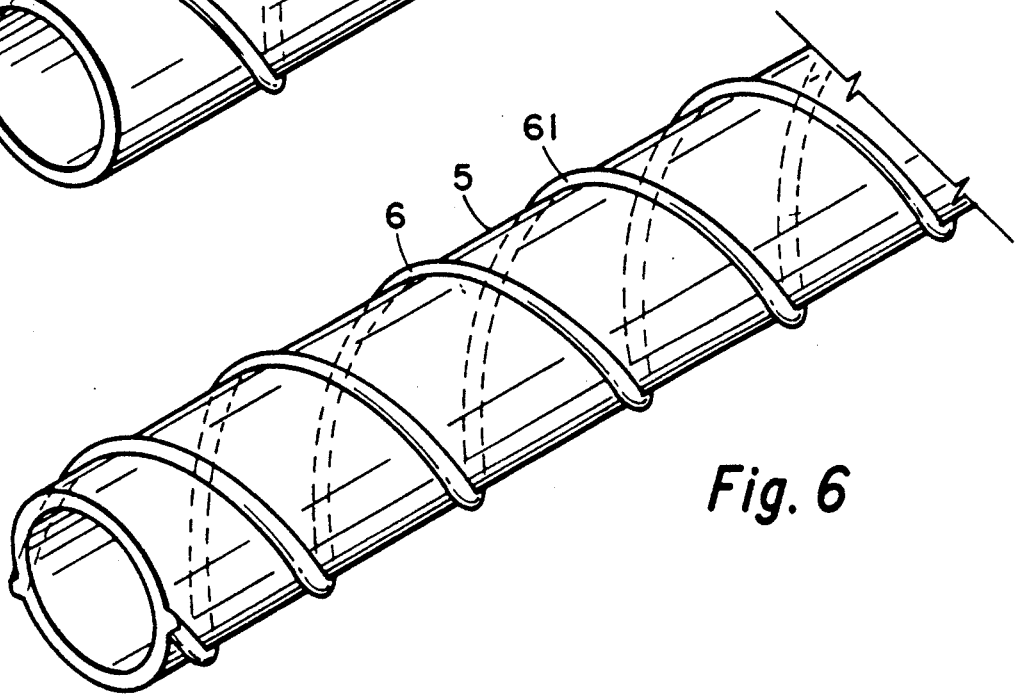
FIG. 6 shows a length of drill pipe having two helical ridges disposed thereabout.

FIG. 6 shows a similar length of drill pipe 5 having helical ridges 6 and 61 disposed thereabout in a double helix.

The invention is not limited to any particular number of helixes disposed about the drill pipe, however, one to three is usually most practical.

Figure 7:
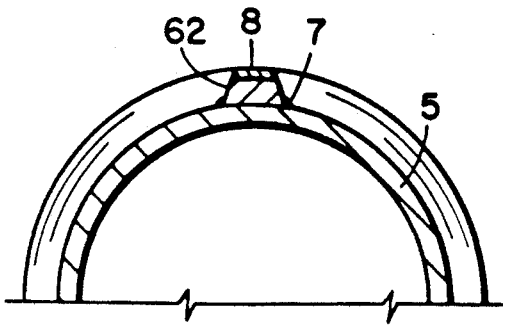
FIG. 7 shows a section of steel drill string having a helical ridge of trapezoidal cross section welded thereto wherein the helical ridge has an outer surface of a wear resistant material.

FIG. 7 shows an embodiment of the invention wherein drill pipe 5 has a helical ridge 62 affixed thereto with welds 7. The helical ridge has an outer surface 8 of a wear resistant material disposed thereon. The wear resistant material can comprise carbon, aramid pulp, polytetrafluoroethylene, tungston carbide, a ceramic or the like which can be suspended in a resin or metal matrix binder, for example.

Figure 8:
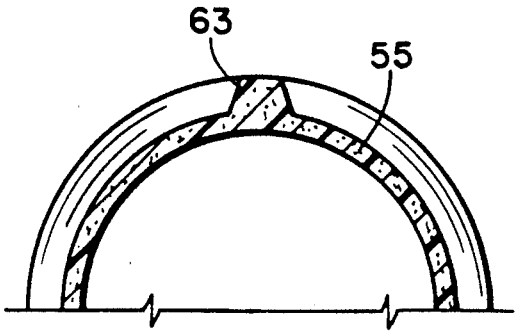
FIG. 8 shows a cross section of drill string comprised of a high strength composite wherein the helical ridge is integral therewith.

FIG. 8 shows yet another embodiment of the invention wherein drill pipe 55 has helical ridge 63 fabricated integral therewith. In this embodiment, the drill pipe is fabricated of a high strength composite such as carbon fiber, aramid, or fiberglass reinforced thermoset polymer or thermoplastic.

It is not essential that the length of drill pipe having the helical ridge disposed thereabout be the same length as other lengths of drill pipe. In some situations, it is even possible to use rather short lengths of drill pipe in the highly angulated wellbore.

It is necessary that the root of the helical ridge be sufficiently wide that it can be securely affixed to the drill string such that it will not be torn loose in drilling operations. Preferably, the width of the root of the helical ridge is 0.25 to 25 percent of the outer circumference of the drill pipe.

While only a limited number of embodiments of the present invention have been illustrated and described herein, it is apparent that various modifications and changes may be made without departing from the principals of the invention in its broader aspects.

We claim:

1. In a method for drilling a highly angulated wellbore with a rotary rig having a drill string terminated with a bit which method employs drilling fluid; the improvement comprising;

employing a length of drill pipe in the highly angulated drill string which has a helical ridge disposed thereabout, wherein the flight of the helical ridge is wound in the same direction as the rotation of the drill string such as to move drill cuttings in a direction from the bit to the surface upon rotation, and wherein the height of the helical ridge above the circumferential surface of the length of the drill pipe is 1 to 15 percent of the diameter of the drill pipe.

2. The method of claim 1 wherein the length of drill pipe having the helical ridge is adjacent to the drill bit.

3. The method of claim 1 wherein a plurality of lengths of drill pipe having the helical ridge are employed.

4. The method of claim 3 wherein the ratio of drill pipes having the helical ridge to ordinary drill pipes in the highly angulated wellbore is at least 2 to all.

5. The method of claim 4 wherein the angulated wellbore is not more than 45 degrees from horizontal.

6. The method of claim 1 wherein the height of the helical ridge is 1 to 10 percent of the diameter of the drill pipe, and wherein a 360° rotation of the helical ridge has a length axial to the drill string of 50 to 500 percent of the outer diameter of the drill pipe.

7. The method of claim 5 wherein the height of the helical ridge is 2 to 8 percent of the diameter of the drill pipe, wherein a 360° rotation of the helical ridge has a length axial to the drill string of 100 to 200 percent of the diameter of the drill pipe, and wherein the width of the root of the helical ridge is 0.25 to 25 percent of the outer circumference of the drill pipe.

8. A drill string in a highly angulated wellbore rotatively connected to a rotary drill rig which circulates drilling fluid and a drill bit which comprises a length of drill pipe which has a helical ridge disposed thereabout;

wherein the flight of the helical ridge is wound in the same direction as the rotation of the drill string such as to move drill cuttings in a direction from the drill bit to the surface upon rotation, and wherein the height of the helical ridge above the circumferential surface of the length of the drill pipe is 1 to 15 percent of the diameter of the length of drill pipe.

9. The drill string of claim 8 wherein the length of drill pipe having the helical ridge is adjacent to the drill bit.

10. The drill string of claim 8 wherein a plurality of lengths of drill pipe having the helical ridge are employed.

11. The drill string of claim 8 wherein the angulated wellbore is not more than 45 degrees from horizontal.

12. The drill string of claim 8 wherein the height of the helical ridge is 1 to 10 percent of the diameter of the drill pipe, wherein a 360° rotation of the helical ridge has a length axial to the drill string of 50 to 500 percent of the diameter of the drill pipe, and wherein the width of the root of the helical ridge is 0.25 to 25 percent of the outer circumference of the drill pipe.

13. The drill string of claim 12 wherein a plurality of lengths of drill pipe having helical ridge are employed and wherein one of the length of drill pipe having the helical ridge is adjacent to the drill bit.

14. The drill string of claim 8 wherein the ridge has an outer surface of a wear resistant material.

15. The drill string of claim 14 wherein the wear resistant material is comprised of carbon, aramid pulp, polytetrafluoroethylene, tungston carbide, or a ceramic and wherein the ridge increases the torsional stiffness and buckling resistance of the drill pipe.

16. The drill string of claim 8 wherein the length of drill pipe is fabricated of a high strength composite and the helical ridge is integral therewith.

17. The drill string of claim 12 wherein the length of drill pipe is fabricated of a high strength composite and the helical ridge is integral therewith.

* * * * *